United States Patent [19]

Albert

[11] Patent Number: 4,960,373

[45] Date of Patent: Oct. 2, 1990

[54] FLUID MOTOR ROTOR ASSEMBLY

[75] Inventor: Gregory P. Albert, Waverly, N.Y.

[73] Assignee: Ingersoll-Rand Company, Woodcliff Lake, N.J.

[21] Appl. No.: 325,568

[22] Filed: Mar. 17, 1989

[51] Int. Cl.[5] ..... F01C 13/02

[52] U.S. Cl. ..... 418/270; 173/163

[58] Field of Search ..... 418/131, 133, 270; 173/104–111, 145, 163

[56] References Cited

U.S. PATENT DOCUMENTS

| | | | |
|---|---|---|---|
| 3,193,190 | 7/1965 | Lindberg | 418/131 |
| 3,826,597 | 7/1974 | Schmitz | 418/131 |
| 4,268,233 | 5/1981 | Fernström | 418/270 |
| 4,526,524 | 7/1985 | Kondo et al. | 418/270 |

*Primary Examiner*—John J. Vrablik
*Assistant Examiner*—David L. Cavanaugh
*Attorney, Agent, or Firm*—Robert F. Palermo; Arthur N. Trausch

[57] ABSTRACT

A rotor assembly for a vane motor has a cylindrical rotor body having front and rear shafts extending axially from the front and rear rotor faces, respectively. The rotor is rotatably supported in front and rear bearings and has radial slots extending axially along the rotor body. Radially slidable vanes are provided in each radial slot, and a rear end plate is fixed to the rear face of the rotor body so as to rotate with the rotor and to completely close the slots on the rear face of the rotor. A spacer is provided at the front face of the rotor body to provide clearance for a front end plate which radially circumscribes the front spacer so as to close the radial slots at the front face while still permitting relative rotation between the spacer and the front end plate. The spacer may be integrally formed with the shaft or may be of a separate piece fitting to the shaft.

4 Claims, 3 Drawing Sheets

FLUID MOTOR ROTOR ASSEMBLY

BACKGROUND OF THE INVENTION

The present invention relates to fluid motors and in particular to fluid vane motors having sliding vanes.

Vane motors are well known and typically include a tubular housing within which a rotor, having radially slidable vanes, is arranged for rotation about an axis offset from the axis of the tubular housing. Openings through the circumferential sides of the tubular housing or the end plates of the housing define inlet and outlet ports for the fluid motor. Positioning of the ports determines the direction of rotation of the rotor.

The ends of the motor cylinder are closed by end plates typically clamped against the end of the cylinder. The end plates also typically support the bearing assemblies for the rotor. The bearings are conventionally located in cavities on the outside of the end plates. Manufacture, assembly, disassembly, and repair of conventional rotor assemblies is difficult because of the complex construction. The end plates and housing members must be disassembled to gain access to the individual components

SUMMARY OF THE INVENTION

It is therefore an object of the present invention to provide a vane motor assembly having fewer and simpler parts than conventional vane motor constructions.

It is another object of the present invention to provide a vane motor construction having easier manufacture, assembly, disassembly, and repair.

It is another object of the present invention to provide a rotor assembly having reliable take-up for axial movement or tolerance.

It is a further object of the present invention to reduce the number of parts for a vane motor.

In one aspect of the present invention, the above objects are accomplished by providing a cylindrical rotor body having front and rear faces and front and rear shaft portions supported by bearings and extending axially from the respective faces. Radial vane slots extend axially along the rotor body. A rear end plate, having an outside diameter equal to the outside diameter of the rotor body and substantially equal to that of the rear bearing, is fixed to the rear face of the rotor body on the rear shaft so as to completely close the vane slots at the rear face. A front spacer member is positioned on the front shaft portion so as to abut the front face of the rotor body. A front end plate radially circumscribes the front spacer member so as to close the vane slots at the front face while allowing relative rotation between the spacer and the front end plate.

The foregoing and other aspects of the present invention will become apparent from the following detailed description of the invention when considered in conjunction with the accompanying drawings. It is to be understood, however, that the figures are not intended as a definition of the invention but are for the purposes of illustration only.

DETAILED DESCRIPTION OF THE PREFERRED EMBODIMENT

Figure 1:
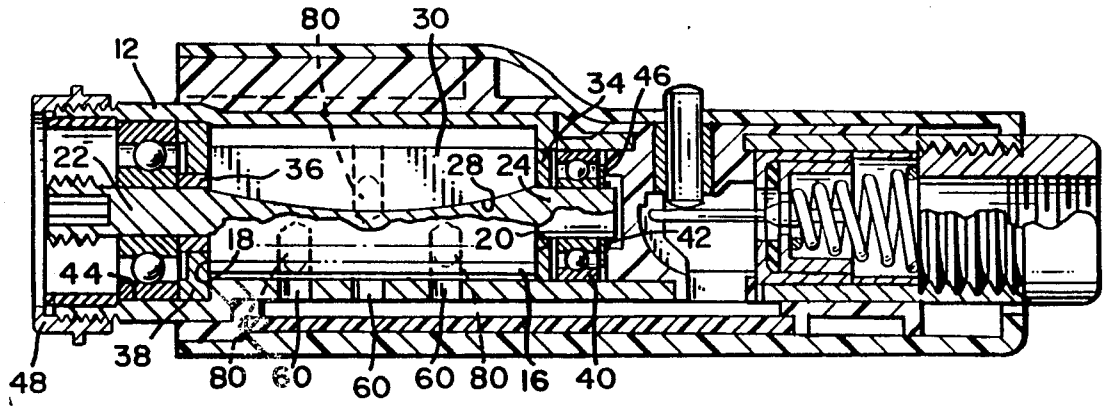
FIG. 1 is a cross sectional side view schematically illustrating an embodiment of the vane motor assembly of the present invention.
Figure 2:
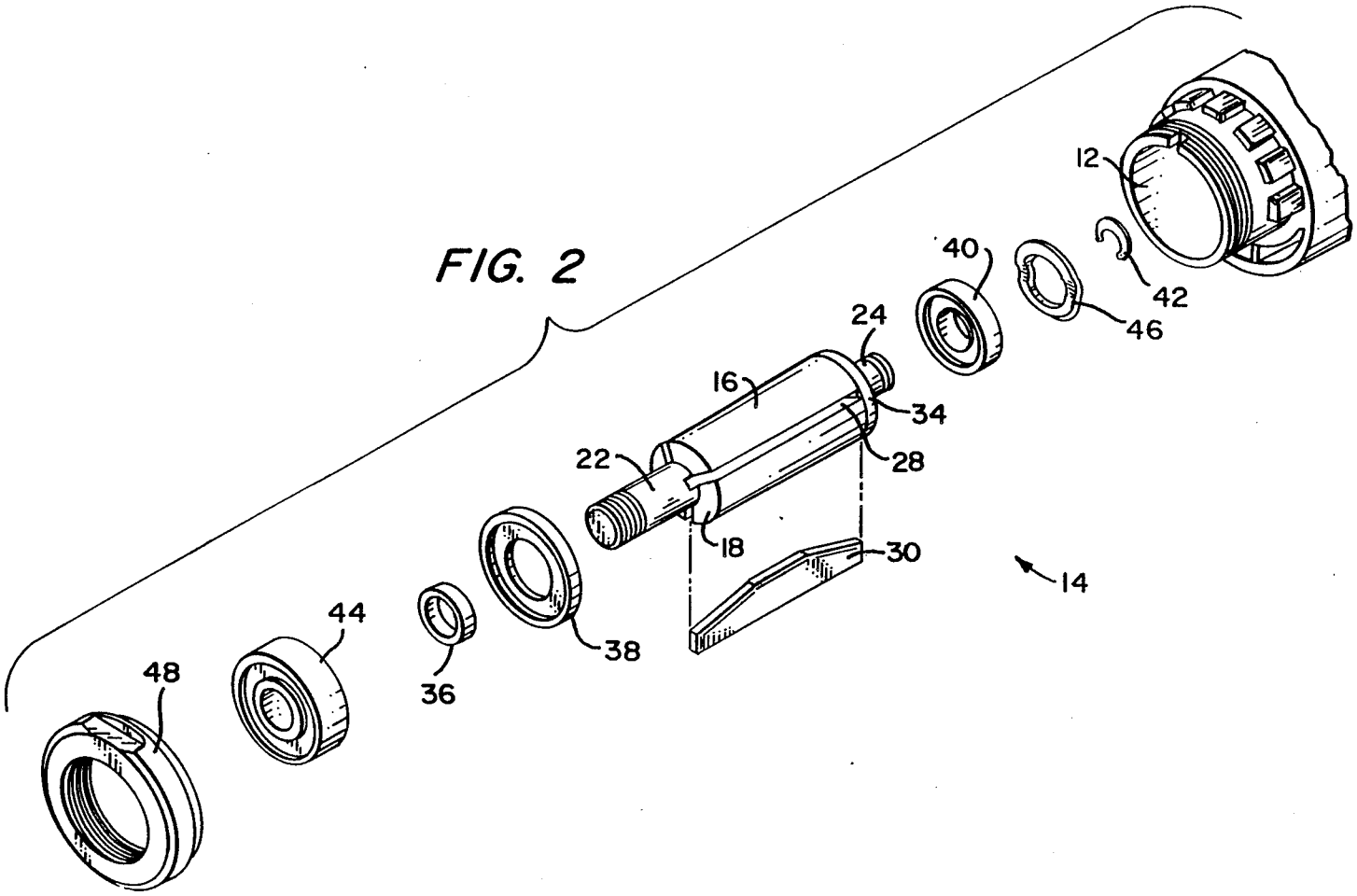
FIG. 2 is an exploded perspective view of the vane motor assembly according to the invention.

In FIGS. 1 and 2, a fluid vane motor includes a hollow cylinder 12 within which a rotor assembly, shown generally by 14, is disposed. The rotor assembly, which is supported on front and rear bearings, includes a cylindrical rotor body 16 having front 18 and rear 20 faces. A front shaft portion 22 and a rear shaft portion 24 extend axially from the respective front and rear faces. A plurality of radial vane slots 28 extend axially along the outer circumferential surface of the rotor body. The slots are evenly spaced around the circumference. Radial vanes 30 are slidably disposed in each radial slot such that the length of each vane is approximately equal to the length of the rotor body. The length of the rotor body 16 is approximately equal to the axial length of the hollow cylinder 12. Motive fluid for rotating the rotor 16 is supplied through fluid inlet ports 60 and is exhausted through fluid outlet ports 80 in the walls of motor cylinder 12.

The rotor 16 is mounted for rotation within the hollow cylinder about an axis parallel to and offset from the axis of the hollow cylinder. In other words, the rotor rotates in a circular chamber eccentrically offset from the center axis of the hollow cylinder member, as is conventional for vane fluid motors.

A rear end plate 34 having an outside diameter equal to that of the rotor body and substantially equal to that of the rear bearing, is fixed to the rear face 20 of the rotor body 16 so as to completely close the vane slots at the rear face. In the preferred embodiment, for example, the inner diameter of the annular rear end plate 34 may be such that the rear end plate is press fit onto the rear shaft 24. Alternatively, the rear end plate may be fixedly attached in a manner such as welding or may be machined as an integral part of the rotor body 16.

Figure 3:
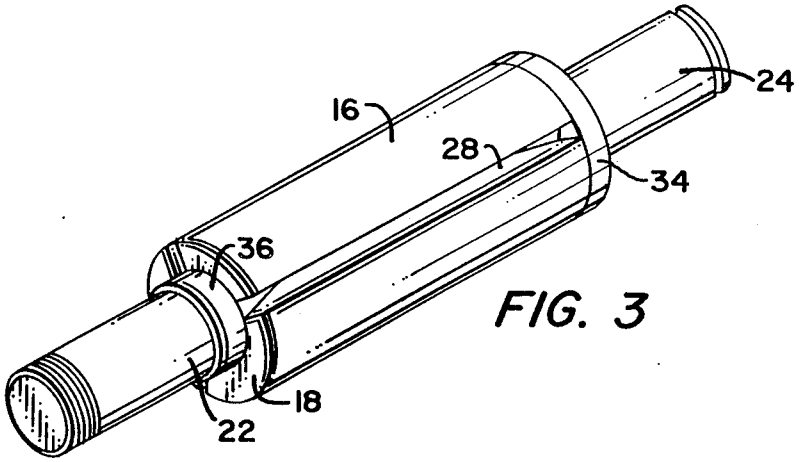
FIG. 3 is a perspective view of another embodiment of the rotor.

A front spacer member 36 has an annular shape. The inner diameter is such that the spacer member can be slid on the front shaft 22 so as to abut the front face 18 of the rotor body 16. Since the spacer 36 rotates with the rotor body 16, it could alternatively be manufactured as a stepped shoulder on the front shaft 22 as shown in FIG. 3.

A front end plate 38 has a larger dimensioned annular shape such that the inner diameter of the front end plate will slide over the outer diameter of the front spacer member 36 so as to allow rotation of the spacer member 36 and rotor 16, relative to the end plate 38. The front end plate 38 radially circumscribes the front spacer member 36 and seals the front opening of the rotor chamber so as to close the slots 28 at the front face 18 of rotor 16.

A rear bearing 40, such as an antifriction roller bearing, having an outside diameter substantially equal to that of rotor 16 and rear end plate 34 is positioned on the rear shaft 24 and is retained by means such as a press fit and a retaining ring 42. A front bearing 44 is pressed onto the front shaft 22. The front bearing 44 is axially positioned relative to the rotor 16 by the front spacer member 36.

The slidable vanes 30 are installed in the vane slots 28 and the completed rotor assembly 14 is positioned in the rotor chamber. A forward biasing means such as a wave spring 46 is placed behind the rear bearing 40 to provide bias for axially locating the rotor assembly. A clamp nut 48 is then tightened against the outer race of the front bearing to axially secure the motor parts.

The serviceable parts of the rotor of the present invention are easily accessible for maintenance by simply unscrewing clamp nut 48 and removing the rotor assembly 14. The part count compared to a typical conventional vane motor construction is less. Additionally, since the rotor assembly has an integral rear plate 34, the vanes will not slide axially when the rotor assembly 14 is inserted or removed from the rotor chamber.

The rear end plate 34 is fixed to the rotor body 16 and rotates with the rotor body. Thus the rotor body is not confined on the rear end by a stationary end plate and can therefore take up axial movement or axial tolerances. Fabrication of cylinder 12 is also simplified by providing a common outside diameter for the rotor 16, fixed rear end plate 34, and rear bearing 40. Only a single smooth bore and a small crescent shaped end face need be finished to accommodate the rotor assembly. This is best illustrated in FIG. 1.

Typical steps in assembling a rotor assembly according to the present invention are as follows: a rear end plate 34 is pressed onto the rear shaft 24 of the rotor body 16. The outer diameter of the completed rotor is then ground to tolerance. The rear bearing 40 is pressed onto the rear shaft and a retaining ring 42 is positioned to further retain the bearing. The front spacer member 36 is slid on the front shaft 22. The front end plate 38 is slid over the outer diameter of the front spacer 36 so as to circumscribe the front spacer member. The front bearing 44 is pressed onto the front shaft 22. The inner face of the front bearing is ground flush to fit against the face of the spacer member 36 so as to provide the proper clearance between the rotating rotor 16 and the stationary end plate 38. Vanes 30 are disposed in each slot 28.

The rotor assembly 14 is then positioned in the eccentric cylinder chamber to abut against a wave spring washer 46 which provides forward axial bias of the rotor. The clamp nut 48 is then tightened against the outer race of the front bearing 44 to axially secure the motor parts. The spacer member 36 is clamped tightly between the bearing inner race and the front face 18 of the rotor body. The inner race, spacer member and rotor body thus all rotate as a unit. A power takeoff spindle is located on the front shaft 22 to provide power takeoff for the rotational force developed by the motor when energized.

While this invention has been illustrated and described in accordance with a preferred embodiment of a vane rotor in a handheld pneumatic tool, it is recognized that variations and changes may be made therein without departing from the invention as set forth in the claims.

I claim:

1. A rotor assembly for a vane motor comprising:

a cylindrical rotor body having front and rear faces, front and rear shaft portions extending axially from the respective faces, front and rear bearings for rotatably supporting said shaft portions, respectively, and radial slots extending axially along the rotor body;

a plurality of radially slidable vanes disposed in said radial slots;

a rear end plate, having the same outside diameter as that of said rotor body and substantially the same as that of said rear bearing, fixed to the rear face of said rotor body on said rear shaft so as to rotate with said rotor body and to completely close the slots at the rear face;

a front spacer member positioned on the front shaft portion so as to abut the front face of the rotor body; and a front end plate radially circumscribing the front spacer member so as to close the slots at the front face while allowing relative rotation between said spacer and said front end plate.

2. The rotor assembly of claim 1 wherein said front spacer is integrally formed with said front shaft portion.

3. A fluid vane motor comprising:

a hollow cylinder having fluid inlet and outlet ports;

a rotor assembly mounted for rotation within said cylinder about an axis parallel to the axis of said cylinder, said rotor assembly comprising:

a rotor body having front and rear faces, front and rear shaft portions extending axially from the respective front and rear faces, front and rear bearings for rotatably supporting said shaft portions, respectively, and radial slots extending axially along the rotor body;

a plurality of radially slidable vanes disposed in said radial slots;

a rear end plate, having the same outside diameter as that of said rotor body and substantially the same as that of said rear bearing, fixed to the rear face of said rotor body on said rear shaft so as to rotate with said rotor body and to completely close the slots at the rear face;

a front spacer member positioned on the front shaft portion so as to abut the front face of the rotor body; and a front end plate radially circumscribing the front spacer member so as to close the slots at the front face while allowing relative rotation between said spacer and said front end plate.

4. The vane motor of claim 3 wherein said front spacer is integrally formed with said front shaft portion.

* * * * *